US009943884B2

(12) United States Patent
Viola

(10) Patent No.: US 9,943,884 B2
(45) Date of Patent: Apr. 17, 2018

(54) PET HAIR GATHERING TOOL

(71) Applicant: Charles A. Viola, Fairfield, IA (US)

(72) Inventor: Charles A. Viola, Fairfield, IA (US)

( * ) Notice: Subject to any disclaimer, the term of this patent is extended or adjusted under 35 U.S.C. 154(b) by 0 days.

(21) Appl. No.: 14/998,907

(22) Filed: Mar. 3, 2016

(65) Prior Publication Data

US 2017/0252780 A1 Sep. 7, 2017

(51) Int. Cl.

| | |
|---|---|
| ***B08B 1/00*** | (2006.01) |
| ***B08B 7/00*** | (2006.01) |
| ***A47L 25/00*** | (2006.01) |

(52) U.S. Cl.

CPC ..... *B08B 1/001* (2013.01); *A47L 25/00* (2013.01); *B08B 7/0028* (2013.01)

(58) Field of Classification Search

None

See application file for complete search history.

(56) References Cited

U.S. PATENT DOCUMENTS

| | | | | |
|---|---|---|---|---|
| 3,035,297 A * | 5/1962 | Overman | B60S 1/38 | 15/250.48 |
| 3,200,431 A * | 8/1965 | Thompson | B60S 1/38 | 15/250.41 |
| 5,690,057 A * | 11/1997 | Curry | A01K 13/002 | 119/623 |
| D422,765 S * | 4/2000 | Viola | D32/35 | |
| D630,812 S * | 1/2011 | Williams | D32/41 | |
| 2002/0100135 A1* | 8/2002 | Machesky | A47L 1/06 | 15/245 |

* cited by examiner

*Primary Examiner* — Nicole Blan

(57) ABSTRACT

An improved device and method for gathering up loose pet hair, lint, and other fine debris from a variety of surfaces. In the preferred embodiment, the device includes a handle and a blade. The blade is made of an elastromeric material that is flexible. Exposed surfaces of the blade have a rough, crinkled, pebble-grain texture, such as crepe rubber. The blade is greater in height than in thickness; greater in width than in height; and wider at the bottom end than at the top end, where it is connected to the handle. The handle of the device is held by the user, while the bottom end, side ends, or front and back surfaces of the blade are placed on the surface to be cleaned and dragged with slight pressure across the cleaning surface. The blade dislodges, grips, and gathers up loose pet hair and other fine debris into a wad so that it may be removed by hand or by vacuum suction.

16 Claims, 3 Drawing Sheets

FIG. 6
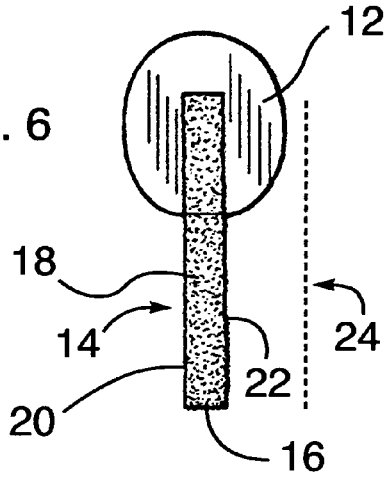
FIG. 7
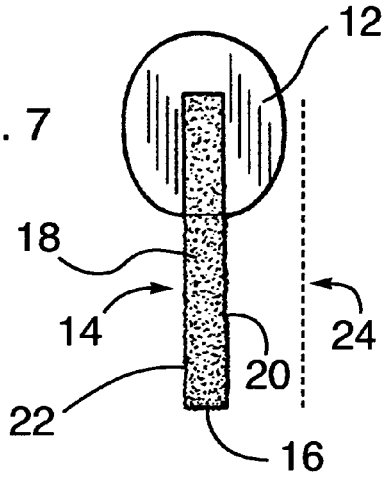
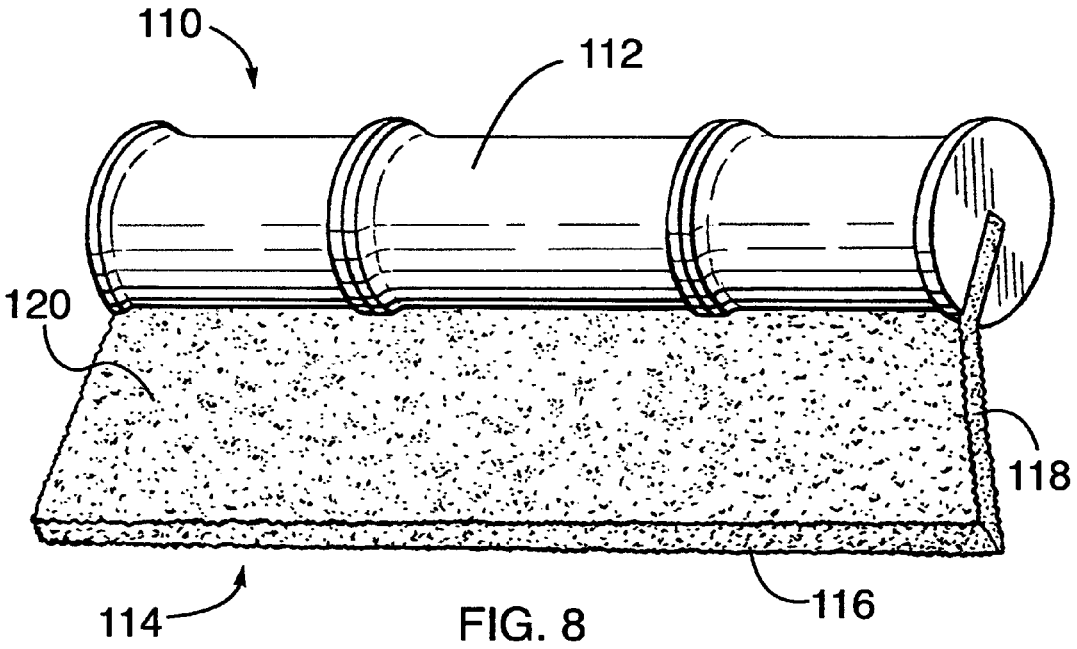
FIG. 8

PET HAIR GATHERING TOOL

BACKGROUND

Field

The present disclosure relates generally to devices and methods for cleaning loose pet hair, lint, and other fine debris from a variety of surfaces, including upholstery, carpets, drapes, automobile interiors, pet beds, and clothing.

Description of Related Art

Some prior devices created for performing the above tasks incorporate a tacky surface, such as a sticky pad or a sticky roller, that grabs and holds the loose pet hair or other fine debris, thereby removing it from the area that is being cleaned.

U.S. Pat. No. 3,158,887 to Kanbar et al. discloses a device that incorporates a roller with a sticky surface that collects loose debris from surfaces. U.S. Pat. No. 3,056,154 discloses a device that uses a glove with removable sticky pads. As the wearer of the glove wipes the sticky pads across the surface to be cleaned, the sticky pads pull loose debris from the surface. U.S. Pat. No. 3,373,457 to Rouch discloses a device that uses removable sticky sheets.

One limitation of such sticky-surfaced devices is that the sticky surface quickly becomes filled with debris, rendering it non-sticky and incapable of picking up any more debris. Therefore, such devices are not useful for cleaning up large amounts of debris, such as the amount of hair that a shaggy dog might leave on the family couch. Also, sticky-surfaced devices are not very effective at dislodging embedded debris, such as pet hair that has become interwoven into the fabric of upholstery or into the fibers of a carpet.

U.S. Pat. No. 8,763,190 to Ross shows a device that uses a rubber brush to dislodge the embedded pet hair and a sticky-surfaced roller to collect the pet hair that has been dislodged. While the rubber brush may be somewhat effective at dislodging pet hair, it may not be completely effective at gathering it, and the sticky roller is limited in how much hair it can retain before it becomes full of pet hair and therefore incapable of removing any more.

Some devices use a roller or a pad, covered with a directional fabric that, when brushed in the proper direction across the surface to be cleaned, is capable of picking up and holding small debris such as lint or pet hair. Such devices covered with directional fabric are limited in that they must be moved across the surface in the proper direction only. If they are moved in the wrong direction, they may not pick up the debris and may actually release some debris onto the surface that is being cleaned. Also, they are limited in how much debris they can collect before becoming ineffective. Further, they may not be able to reach debris that is deeply embedded, such as pet hair that has become interwoven into carpet. U.S. Pat. No. 7,039,982 and U.S. Pat. No. 7,020,926 to McKay disclose devices that incorporate a roller brush covered with such a directional fabric.

Another variety of device for removing unwanted loose pet hair, lint, etc. incorporates a blade made of rubber or other elastomeric material, such as the type found in a common squeegee. When such a blade is dragged with downward pressure, across the surface to be cleaned, it is partially effective at pulling out loose pet hair and other debris from the fibers of cloth or carpet. Such squeegee-like devices are used to gather the pet hair or other collected material into a wad, which can then be removed by hand or vacuum suction.

Squeegees are usually used to remove liquids, such as water, from smooth surfaces, such as glass or tile. The wiping surface of the blade of a squeegee is smooth so that it can make close contact with the smooth surface it is wiping across and thereby effectively remove liquid from the surface. While the smooth blade of a squeegee is optimized for removing liquids from smooth surfaces, it is not very well suited for removing solid matter, such as pet hair, from non-smooth surfaces, such as shag carpet, clothing, or upholstery fabric.

U.S. Pat. No. 1,907,370 to Scholler discloses a device, for removing pet hair from surfaces, that incorporates crepe rubber strips. Scholler's device is intended for use on flat surfaces such as floors and so the low-relief crepe rubber strips are attached to a rigid substrate to keep them flat. As such, they are not flexible enough to be effective on non-flat surfaces, such as the rounded arm of an upholstered chair.

BRIEF SUMMARY

The present invention is a device for gathering up loose pet hair, lint, or other fine debris from a variety of surfaces. The device comprises a blade attached to a handle. The blade is greater in width than it is in height and is greater in height than it is in thickness.

The blade has a top and bottom end; the top end being attached to the handle. The bottom end is essentially straight and is greater in width than the top end. The width of the blade bottom end is greater in width than the top end, the side ends are flared out at angle from the increases uniformly between the handle and the bottom end of the blade. Because the handle, allowing them to access hard-to-reach areas.

BRIEF DESCRIPTION OF THE SEVERAL VIEWS OF THE DRAWINGS

FIG. 6 shows a right end view thereof.
FIG. 7 shows a left end view thereof.
FIG. 8 shows a perspective view of an alternative embodiment of the invention.

REFERENCE NUMERALS IN THE DRAWINGS

Figure 1:
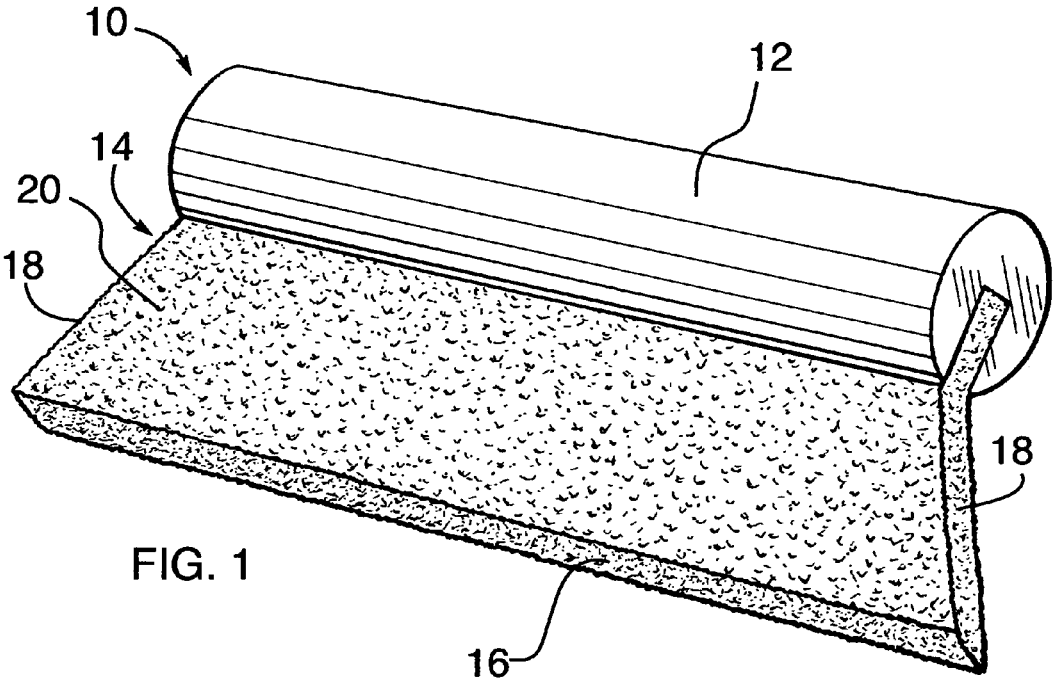
FIG. 1 shows a perspective view of the invention.
Figure 2:
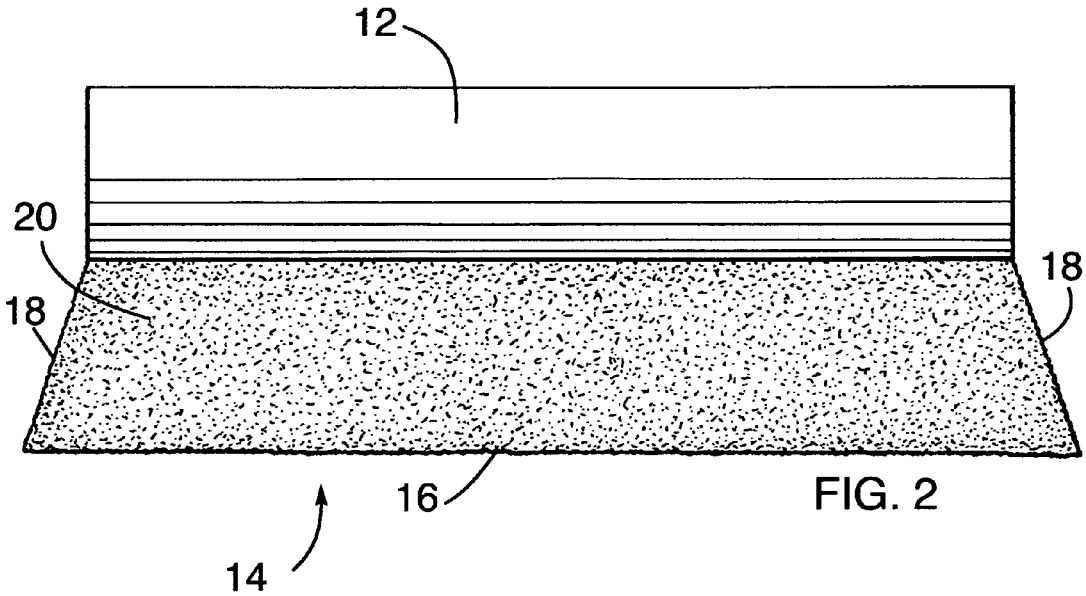
FIG. 2 shows a front elevational view thereof.
Figure 3:
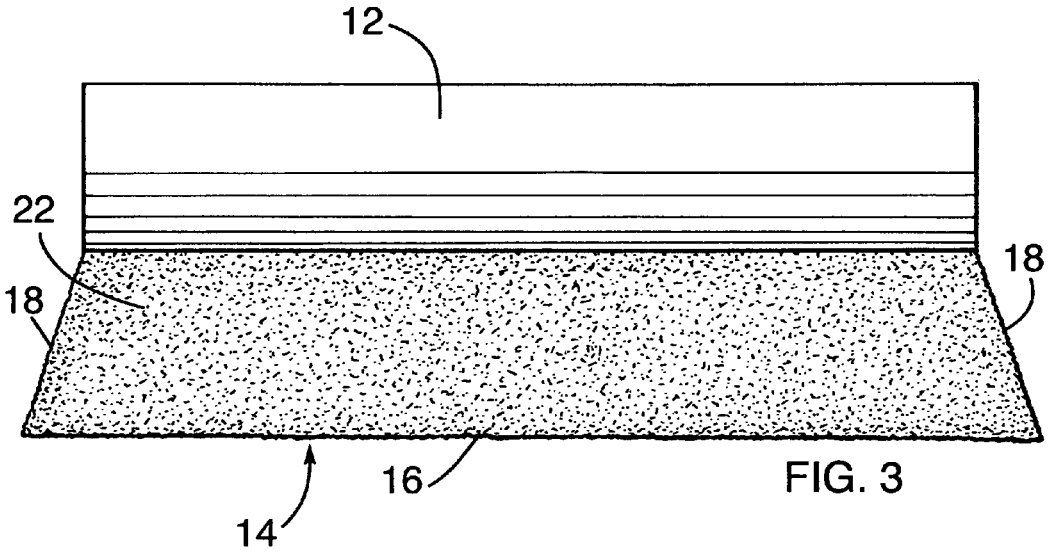
FIG. 3 shows a back elevational view thereof.
Figure 4:
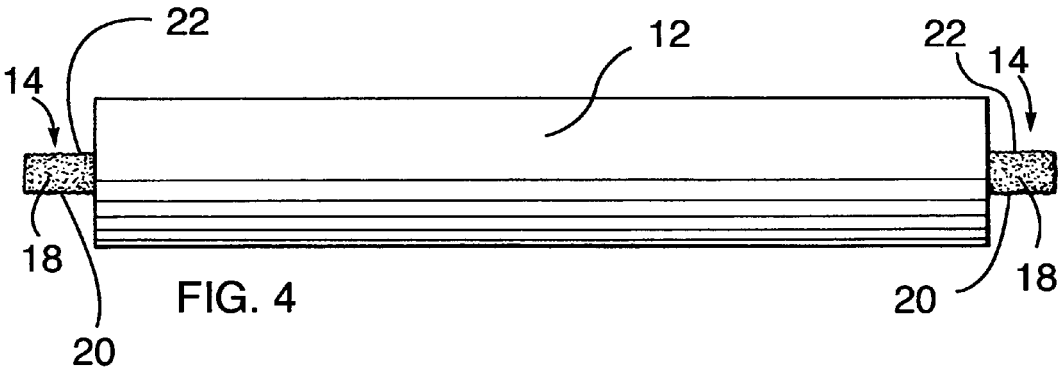
FIG. 4 shows a top plan view thereof.
Figure 5:
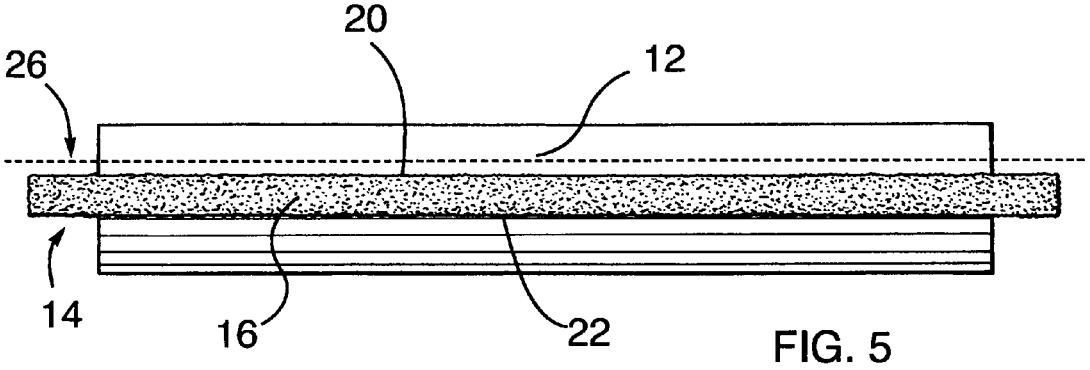
FIG. 5 shows a bottom plan view thereof.

10 invention
12 handle
14 blade
16 bottom end of blade
18 side end of blade
20 front surface of blade
22 back surface of blade
24 vertical axis of the blade
26 horizontal axis of the blade
110 alternative embodiment of the invention
112 handle
114 blade
116 bottom end of blade
118 side end of blade
120 front surface of blade

DETAILED DESCRIPTION OF THE INVENTION

An exemplary device 10 as disclosed herein is used to gather up loose pet hair, or other fine debris, such as lint, from a variety of surfaces, including upholstered furniture, carpets, automobile interiors, pet beds, and clothing. The device 10 includes a handle 12 having a blade 14 attached thereto. The exemplary handle 12 shown in FIG. 1 is substantially cylindrical and includes a slot for receiving the top end portion of the blade 14. The length of the handle 12 is substantially the same as the width of the top end portion of the blade 14. The blade 14 as illustrated in the figures, includes a bottom end 16, side ends 18, a front surface 20, and a back surface 22. The portion of the blade 14 extending from the handle 12 has a trapezoidal configuration. The minimum width of the blade 14, which is the distance between the side ends 18 near the handle in embodiments including trapezoidal blades, exceeds the height of the blade 14, which is the distance between the handle 12 and the bottom end 16 of the blade 14. The ratio of the minimum blade width to the blade height is at least 5:1 in some embodiments of the device 10. The height of the blade 14 may be at least one inch (1") to facilitate effective use of the front 20 and/or back surfaces 22 of the blade for removing debris. The user of the device 10 holds the handle 12 and places the bottom end 16 of the blade 14 in contact with the surface to be cleaned. With slight downward pressure, the user drags the bottom end 16 of the blade 14 along the surface to be cleaned.

It will be appreciated that all exposed surfaces of the blade 14 can be employed for gathering materials such as hair and lint in embodiments wherein such surfaces have a rough, crepey texture, as described further below.

The side ends 18 of the blade 14 may also be dragged, with slight pressure, along the surface to be cleaned, for example when the user is cleaning between two cushions, or is cleaning a recessed area that cannot be reached by the bottom end 16 of the blade 14, or is cleaning an area that is too small to accommodate the bottom end 16 of the blade 14.

The front surface 20 and back surface 22 of the blade 14 may also be dragged, with slight pressure, across the surface to be cleaned. The front surface 20 and back surface 22 of the blade 14, being larger in area, than the bottom end 16 or side ends 18 of the blade 14, provide a broader and more flexible means for cleaning certain surfaces and greater contact areas with such surfaces. The flexibility of the blade 14 along the horizontal axis 26, allows the blade 14 to conform to sharply curved surfaces such as a sleeve or trouser leg, or the curved arm of an upholstered chair.

During the dragging process, the roughly textured, slightly gummy material of the blade 14 contacts the embedded or loose pet hair or other fine debris, thereby gripping, pulling, and gathering the debris into a wad. The wad of pet hair and/or other debris may then be picked up by hand or by vacuum suction, in order to dispose of it.

The blade 14, being greater in height and width than in thickness, tends to flex or deform slightly along its vertical axis 24, and/or its horizontal axis 26, when it is dragged with pressure along the surface to be cleaned. Such flexing of the blade 14 allows it to maintain contact with the cleaning surface, as the user drags the device along.

Because the blade 14 is greater in width than it is in height, it covers a significant surface area, as it is pulled along.

In the preferred embodiment of the device 10, the bottom end 16 and side ends 18 of the blade 14 extend beyond the width of the handle 12, so that they tend to flex freely, along both the vertical axis 24 and horizontal axis 26, enabling the bottom end 16 and/or side ends 18 to maximize contact with the cleaning surface.

The surfaces of the side 18 and bottom 16 ends are essentially straight and are at a 90-degree angle from (perpendicular to) the front 20 and back 22 surfaces of the blade, allowing them to make maximum contact with the surface to be cleaned. When the device is in normal use, the essentially flat surfaces of the side 18 and bottom 16 ends of the blade provide more contact of the blade with the cleaning surface than if such surfaces were rounded or tapered. The maximized contact with the cleaning surface allows hair or debris to be collected effectively.

In the preferred embodiment, the thickness of the blade 14 is at least one-quarter of an inch (0.25") to provide enough surface contact so that it is effective in pulling up embedded debris, and the height of the blade 14, between the bottom end 16 and the handle 12, is at least one to one inch (1") to allow some flexibility, to allow the front 20 and back 22 surfaces of the blade 14 to contact the cleaning surface, and to allow the blade 14 to reach into surfaces where debris may be deeply embedded, such as carpet.

The blade 14 height is preferably in the range of one inch to one and one-half inches (1.0"-1.5") to facilitate user convenience and product versatility. Blade 14 thickness may be uniform and in the range of three-sixteenths of an inch to five-sixteenths of an inch (0.1875"-0.3125"). In some embodiments, one or more surfaces of the blade 14 may be wavy.

For cleaning a variety of surfaces, such as upholstery, car seats, pet beds, and clothes, the preferred width of the blade 14 is six to eight inches (6.0"-8.0"). For cleaning large areas, such as carpets, a blade 14 width of ten to twelve inches (10.0"-12.0") is preferred.

In the preferred embodiment, the blade 14 is cut from a sheet of crepe rubber. Crepe rubber is a material made of natural latex derived from trees. The latex is mixed with a form of coagulant, such as formic acid, to cause it to coagulate. The coagulum is run through creping machinery, which has rollers that crush and press the material into roughly textured sheets. The wet sheets are then hung in a heated environment to dry.

There are different forms and grades of crepe rubber, such as pale latex crepe (PLC), estate brown crepe (EBC), smoked blanket crepe, re-milled crepe, and flat bark crepe. Although any of the aforementioned varieties of crepe rubber may be used to form the blade, pale latex crepe (PLC) is the preferred grade.

The slightly gummy, grippy quality of natural crepe rubber makes it especially effective at grabbing and pulling the loose pet hair and other fine debris in order to dislodge and collect it, yet the debris does not remain stuck to the crepe rubber as it would to a sticky-surfaced cleaning device, therefore a crepe rubber blade does not become ineffective with use. Moreover, crepe rubber may be easily wiped or washed clean, if necessary.

Crepe rubber has a rough, crinkled, pebble-grain surface texture. The rough texture of crepe rubber makes it ideal for cleaning a variety of surfaces, as it allows the blade 14 to contact and grab the loose debris from multiple angles, as it is dragged over the cleaning surface.

Moreover, because a sheet of crepe rubber has a rough texture on all of its surfaces, every exposed part of the blade can be effective in cleaning debris, thereby giving the user more options for cleaning.

Alternative embodiments may be contemplated in which the blade 14 is molded of a non-slippery, flexible rubber or rubber-like elastomeric material that is poured or injected into a mold that will yield a molded piece with a crinkled, pebble-grain, rough texture, like that of crepe rubber. Suitable materials for making such a molded blade 14 may include, but are not limited to, latex, thermoplastic elastomer (TPE), thermoplastic rubber (TPR), and silicone. The blade 14 can be joined to the handle 12 with an adhesive, fasteners, and/or frictional engagement.

Although the blade 14 does not have to be wider than the handle 12 for the device 10 to be effective, in its preferred embodiment, the blade 14 of the present invention is wider at the bottom end 16 than it is at the top end where it is connected to the handle 12. The greater width along the bottom end 16 allows the blade 14 to extend beyond the sides of the handle 12 and therefore offers improved access to some difficult-to-reach areas to be cleaned.

The front 20 and back 22 surfaces of the blade 14 can be dragged across a surface, to provide more width and flexibility than can be provided by the ends 18 of the blade 14.

The handle 12 and blade 14 could be molded from one unitary piece of material or the blade 14 may be inserted into a separate handle 12 and held in place by fasteners, friction, or adhesive, or a combination thereof. The handle 12 may be made of either rigid or flexible material. The surfaces of the blade 14 should all be essentially flat to maximize contact with most flat surfaces. The blade 14 should be higher than it is thick, in order to have the flexibility to properly adjust to the contours of non-flat surfaces and the blade 14 should be wider than it is high to allow it to clean a significant area at a time. This relationship of height, width, and thickness, allows the blade 14 to flex as necessary along both the vertical 24 and horizontal 26 axes to conform to irregular surfaces.

Alternative embodiments of the device 10 may be contemplated in which the handle takes various forms. FIG. 8 shows an alternative embodiment of the invention 110 in which the handle 112 has an ornamental design.

The corresponding structures, materials, acts, and equivalents of any means or step plus-function elements in the claims below are intended to include any structure, material, or act for performing the function in combination with other claimed elements as specifically claimed. The description of the various embodiments has been presented for purposes of illustration and description, but is not intended to be exhaustive or limited to the form disclosed. Many modifications and variations will be apparent to those of ordinary skill in the art without departing from the scope and spirit thereof. The embodiments were chosen and described in order to best explain principles and practical applications, and to enable others of ordinary skill in the art to understand the various embodiments with various modifications as are suited to the particular use contemplated.

What is claimed is:

1. A device for gathering up loose pet hair, lint, or other fine debris from a variety of surfaces, comprising:

a handle;

a blade attached to the handle, the blade being greater in width than in height and greater in height than in thickness, the blade further including a top end and a bottom end, the top end of the blade being attached to the handle, the bottom end of the blade being comprised of an elastomeric material having a rough, pebble-grain surface texture.

2. The device of claim 1, wherein the blade has a thickness of at least 3/16 of an inch.

3. The device of claim 2, wherein the bottom end of the blade includes an edge adjoining and forming a right angle with a bottom surface of the blade.

4. The device of claim 3, wherein the width of the blade increases uniformly between the handle and the bottom end of the blade.

5. The device of claim 1, wherein the blade consists essentially of crepe rubber.

6. The device of claim 1, wherein the blade is ¾ inch to 2 inches in height.

7. The device of claim 6, wherein the ratio of minimum width of the blade to height of the blade is 4:1 to 8:1.

8. The device of claim 7, wherein all exposed surfaces of the bottom end of the blade have the rough, pebble-grain surface texture.

9. The device of claim 8, wherein the blade consists essentially of crepe rubber.

10. The device of claim 1, wherein the handle is made of a flexible material.

11. A method for gathering up loose pet hair, lint, or other fine debris from a surface comprising:

obtaining a device including:

a handle, and a blade attached to the handle, the blade being greater in width than in height and greater in height than in thickness, the blade further including a bottom end and a top end, the top end of the blade being attached to the handle, the bottom end of the blade being essentially straight and greater in width than the top end of the blade, the blade being comprised of an elastomeric material having a rough, pebble-grain surface texture;

contacting the surface containing debris with a portion of the blade having the rough, pebble-grain surface texture;

pulling the blade along the surface, while applying sufficient pressure to cause flexing of the blade between the handle and the bottom end;

causing debris to form a debris wad on the surface while pulling the blade along the surface, and removing the debris wad.

12. The method of claim 11, wherein the blade has a thickness of at least 3/16 of an inch.

13. The method of claim 12, wherein the bottom end of the blade includes a top edge adjoining and forming a right angle with the top surface of the blade and a bottom edge adjoining and forming a right angle with a bottom surface of the blade, further including contacting the surface with the bottom end of the blade.

14. The method of claim 12, wherein the width of the blade increases uniformly between the handle and the bottom end of the blade.

15. The method of claim 11, wherein the blade consists of essentially crepe rubber.

16. The method of claim 11, wherein all exposed surfaces of the bottom end of the blade have the rough, pebble-grain surface texture.

* * * * *